US012673397B2

(12) United States Patent
Yang et al.

(10) Patent No.: US 12,673,397 B2
(45) Date of Patent: Jul. 7, 2026

(54) WAFER BACKSIDE CLEANING APPARATUS AND METHOD OF CLEANING WAFER BACKSIDE

(71) Applicant: TAIWAN SEMICONDUCTOR MANUFACTURING CO., LTD., Hsinchu (TW)

(72) Inventors: Ching-Hai Yang, Taipei City (TW); Yao-Hwan Kao, Hsinchu County (TW); Huang-Sheng Liu, New Taipei City (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 461 days.

(21) Appl. No.: 16/691,061

(22) Filed: Nov. 21, 2019

(65) Prior Publication Data

US 2020/0171623 A1 Jun. 4, 2020

Related U.S. Application Data

(60) Provisional application No. 62/774,136, filed on Nov. 30, 2018.

(51) Int. Cl.
*B24D 11/00* (2006.01)
*B24B 7/22* (2006.01)

(52) U.S. Cl.
CPC ..... *B24D 11/00* (2013.01); *B24B 7/228* (2013.01)

(58) Field of Classification Search
None
See application file for complete search history.

(56) References Cited

U.S. PATENT DOCUMENTS 5,403,228 A * 4/1995 Pasch ..... B24B 37/22 451/259
5,778,481 A 7/1998 Amsden et al.
(Continued)

FOREIGN PATENT DOCUMENTS

CN 1460043 A 12/2003
CN 1476367 A 2/2004
(Continued)

OTHER PUBLICATIONS

"Professional Plastics, Overview of Fluoropolymer Materials, Jul. 14, 2014, "https://www.professionalplastics.com/professionalplastics/content/downloads/OverviewofFluoropolymers-2014.pdf"" (Year: 2014).*

(Continued)

*Primary Examiner* — David S Posigian
*Assistant Examiner* — Dana Lee Poon
(74) *Attorney, Agent, or Firm* — STUDEBAKER BRACKETT PLLC

(57) ABSTRACT

A wafer cleaning and polishing pad includes a pad having a polishing surface, wherein the polishing surface includes a first material having a Shore D hardness ranging from 50 to 80 and a static coefficient of friction ranging from 0.01 to 0.6. The first material is a fluoropolymer. The pad includes a middle layer and/or a base under the polishing surface. The base includes a second material and the middle layer includes a third material having a lower surface hardness and a higher coefficient of friction than the first material. The polishing surface includes a plurality of grooves with varying groove depth from center of the pad to an edge of the pad.

20 Claims, 8 Drawing Sheets

(56) References Cited

U.S. PATENT DOCUMENTS 5,934,977 A * 8/1999 Marmillion ..... B24B 37/04 451/36
6,090,475 A * 7/2000 Robinson ..... B24D 11/00 451/6
7,641,540 B2 1/2010 Ono et al.
2001/0044263 A1* 11/2001 Andideh ..... B24B 37/26 451/51
2002/0182868 A1* 12/2002 Kramer ..... H01L 21/31053 438/692
2003/0139122 A1* 7/2003 Lawing ..... B24B 37/20 451/288
2004/0053042 A1* 3/2004 Eguchi ..... C08J 7/0427 428/323
2004/0055223 A1* 3/2004 Ono ..... B24D 3/28 51/293
2005/0097727 A1* 5/2005 Iijima ..... B24B 1/00 29/729
2006/0030242 A1* 2/2006 Taylor ..... B24B 37/26 451/41
2006/0240749 A1* 10/2006 Yun ..... B24B 37/26 451/287
2008/0014838 A1* 1/2008 Kim ..... C08L 101/02 451/36
2008/0064302 A1* 3/2008 Fujitani ..... B24B 37/26 451/527
2008/0194076 A1* 8/2008 Chang ..... B81C 1/0038 438/455
2008/0207100 A1* 8/2008 Roy ..... B24B 37/26 451/529
2012/0282849 A1* 11/2012 Kerprich ..... B24B 37/205 451/527
2013/0012106 A1* 1/2013 Kazuno ..... B24B 37/24 451/526
2013/0012108 A1* 1/2013 Li ..... B24D 3/28 451/529
2014/0206261 A1* 7/2014 Roettger ..... B24B 37/24 451/41
2016/0001422 A1* 1/2016 Meana-Esteban ..... B24B 37/22 451/539
2018/0105428 A1* 4/2018 Tawarazako ..... C01B 33/1417
2018/0162078 A1* 6/2018 Hajime ..... C08J 7/06
2018/0193974 A1* 7/2018 Feng ..... B24B 37/24

FOREIGN PATENT DOCUMENTS

CN 102448669 A 5/2012
CN 103429390 A 12/2013
CN 103648716 A 3/2014
CN 103846780 A 6/2014
CN 105358292 A 2/2016
CN 107030589 A 8/2017
CN 108655948 A 10/2018
TW 567114 B 12/2003
TW 201726313 A 8/2017

OTHER PUBLICATIONS

"Friction and Wear of Polymers" ZEUS Technical Whitepaper (2015) Retrieved from http://www.appstate.edu/~clementsjs/polymerproperties/$p$lastics_$friction$5f$w$ear.pdf.
"Plastics Properties Table" Curbell Plastics, Retrieved Nov. 30, 2018, from https://www.curbellplastics.com/Research-Solutions/Plastic-Properties.
"Fluoropolymer Spec Chart" Interplast Inc., Retrieved Nov. 30, 2018, from http://www.interplastinc.com/spec.htm.

* cited by examiner

WAFER BACKSIDE CLEANING APPARATUS AND METHOD OF CLEANING WAFER BACKSIDE

CROSS-REFERENCE OF RELATED APPLICATIONS

This application claims priority to Provisional Application No. 62/774,136, entitled "Wafer Backside Cleaning Apparatus and Method of Cleaning Wafer Backside," filed on Nov. 30, 2018, the entire disclosure of which is incorporated herein by reference.

BACKGROUND

As consumer devices have gotten smaller and smaller in response to consumer demand, the individual components of these devices have necessarily decreased in size as well. Semiconductor devices, which make up a major component of devices such as mobile phones, computer tablets, and the like, have been pressured to become smaller and smaller, with a corresponding pressure on the individual devices (e.g., transistors, resistors, capacitors, etc.) within the semiconductor devices to also be reduced in size.

As consumer devices decrease, controlling variations in the photoresist exposure operation becomes more important. It is necessary to limit photolithographic exposure focus and overlay errors. Photoresist-coated wafers undergo wafer backside cleaning and polishing prior to selective exposure of the photoresist to actinic radiation in order to reduce focus and overlay errors. However, the wafer backside cleaning and polishing can scratch the wafer backside thereby reducing yield. A wafer backside cleaning and polishing method and wafer backside cleaning and polishing apparatus that reduce or eliminate wafer backside scratching are desirable.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION

Figure 1B:
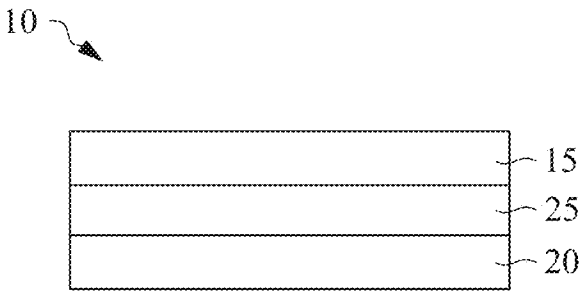
FIG. 1B shows a side view of the wafer cleaning and polishing pad shown in FIG. 1A.

It is to be understood that the following disclosure provides many different embodiments, or examples, for implementing different features of the disclosure. Specific embodiments or examples of components and arrangements are described below to simplify the present disclosure. These are, of course, merely examples and are not intended to be limiting. For example, dimensions of elements are not limited to the disclosed range or values, but may depend upon process conditions and/or desired properties of the device. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Various features may be arbitrarily drawn in different scales for simplicity and clarity.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The device may be otherwise oriented (rotated 90 degrees or at other orientations) and the spatially relative descriptors used herein may likewise be interpreted accordingly. In addition, the term "made of" may mean either "comprising" or "consisting of."

Semiconductor wafers are subject to a wafer backside cleaning and polishing operations after coating the front side of the wafer with a photoresist and prior to selective exposure of the photoresist to improve yield of the exposure operation. Particles remaining on the wafer backside or scratches on the wafer backside can cause focus errors or overlay errors. Cleaning and polishing the wafer backside can reduce focus and overlay errors during the photolithographic exposure operation in a stepper or scanner.

According to various embodiments of the disclosure, a wafer cleaning and polishing pad having a material having a specific range of hardness and coefficients of friction is provided. The material has a higher hardness and a lower coefficient of friction than conventional cleaning and polishing pads. The higher hardness pad as disclosed herein provides improved cleaning and polishing of the wafer surface, while the lower coefficient of friction inhibits scratching of the wafer surface. In some embodiments of the disclosure, backside wafer cleaning and polishing is performed after coating the wafer with photoresist and before selectively exposing the photoresist to actinic radiation. However, the present disclosure is not limited to this operation, and the wafer cleaning and polishing operation can be performed at any suitable time during the semiconductor device manufacturing process.

Figure 1A:
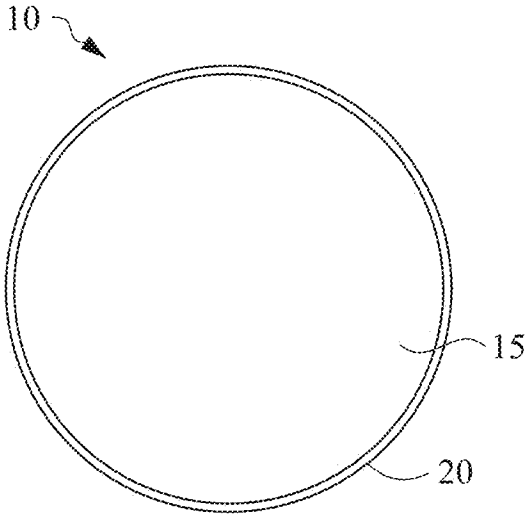
FIG. 1A shows a top view of a wafer cleaning and polishing pad according to an embodiment of the disclosure.

FIG. 1A shows a top view of a wafer cleaning and polishing pad 10 according to an embodiment of the disclosure. As shown in FIG. 1A, the wafer cleaning and polishing pad 10 includes a polishing surface 15 and a base 20. The polishing surface 15 includes a first material having a high hardness and low static coefficient of friction.

In some embodiments, the polishing surface 15 includes the first material having a Shore D hardness ranging from about 50 to about 80. In some embodiments, the Shore D hardness of the first material of the polishing surface 15 ranges from about 55 to about 75, about 60 to about 70, or about 50 to about 70, inclusive of any hardness values therebetween.

In some embodiments, the polishing surface 15 includes the first material having a static coefficient of friction ranging from about 0.01 to about 0.6. In some embodiments, the static coefficient of friction of the first material of the polishing surface 15 ranges from about 0.01 to about 0.55, about 0.01 to about 0.5, about 0.01 to about 0.45, about 0.01 to about 0.40, about 0.01 to about 0.39, about 0.01 to about 0.35, about 0.01 to about 0.3, about 0.01 to about 0.2, about 0.01 to about 0.1, about 0.05 to about 0.6, about 0.05 to about 0.55, about 0.05 to about 0.5, about 0.05 to about 0.45, about 0.05 to about 0.40, about 0.05 to about 0.39, about 0.05 to about 0.35, about 0.1 to about 0.6, about 0.1 to about 0.55, about 0.1 to about 0.5, about 0.1 to about 0.45, about 0.1 to about 0.40, about 0.1 to about 0.39, about 0.1 to about 0.35, about 0.1 to about 0.3, or about 0.1 to about 0.2, inclusive of any static coefficient of friction values therebetween.

In some embodiments, the first material of the polishing surface 15 includes a fluoropolymer. In some embodiments, the fluoropolymer is selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and/or a mixture thereof.

In some embodiments, the base 20 includes a second material that has a Shore D hardness ranging from about 50 to about 80. In some embodiments, the Shore D hardness of the second material of the base 20 ranges from about 55 to about 75, about 60 to about 70, or about 50 to about 70, inclusive of any hardness values therebetween.

In some embodiments, the second material has a static coefficient of friction higher than about 0.4, about 0.6, about 0.8, about 1.0, about 1.2, about 1.4, or about 1.5. In some embodiments, the second material has a static coefficient of friction ranging from about 0.4 to about 1.5. In an embodiment, the second material includes a material made of a polyvinyl chloride or any suitable plastic material.

Figure 1C:
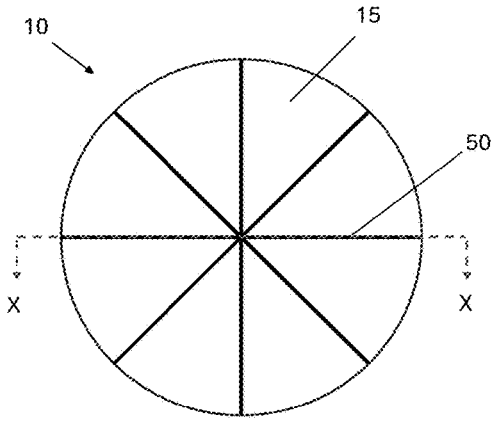
FIG. 1C shows a top view of a wafer cleaning and polishing pad according to an embodiment of the disclosure.
Figure 1F:
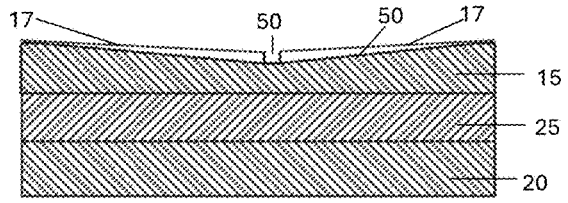
FIG. 1F shows a cross section view along a groove at line X-X of FIG. 1C according to an embodiment of the disclosure.
Figure 1E:
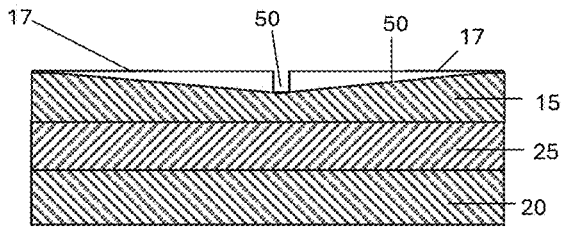
FIG. 1E shows a cross section view along a groove at line X-X of FIG. 1C according to an embodiment of the disclosure.
Figure 1D:
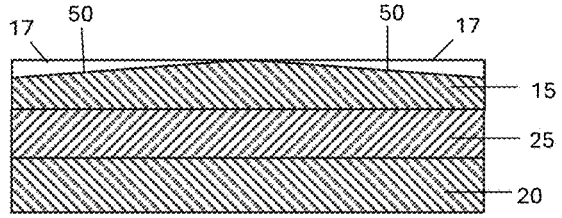
FIG. 1D shows a cross section view along a groove at line X-X of FIG. 1C according to an embodiment of the disclosure.

In an embodiment, the wafer cleaning and polishing pad 10 has a disk shape as shown in FIG. 1A. In an embodiment, the wafer cleaning and polishing pad 10 includes a plurality of grooves 50, as shown in FIG. 1C. In some embodiments, the grooves 50 include a varying groove depth from the center of the wafer cleaning and polishing pad 10 to the edge. In some embodiments, the groove depth increases from the center of the wafer cleaning and polishing pad 10 to the edge, as shown in FIG. 1D, which is a cross section view along a groove at line X-X of FIG. 1C. FIG. 1D schematically illustrates a top 17 of the polishing surface according to an embodiment of the disclosure. In some embodiments, the groove depth decreases from the center of the wafer cleaning and polishing pad 10 to the edge, as shown in FIG. 1E, which is a cross section view along a groove at line X-X of FIG. 1C. FIG. 1E schematically illustrates a top 17 of the polishing surface according to an embodiment of the disclosure. In some embodiments, the groove depth decreases from the center of the wafer cleaning and polishing pad 10 to the edge, and the wafer cleaning and polishing pad has a gradient of increasing thickness beginning at the center and continuing across to the edge of the wafer cleaning and polishing pad as shown in FIG. 1F, which is a cross section view along a groove at line X-X of FIG. 1C. FIG. 1F schematically illustrates a top 17 of the polishing surface according to an embodiment of the disclosure. In some embodiments, the grooves 50 prevent the formation of polishing marks by trapping the polishing particles within the grooves 50 so that during polishing, the contact area of the polishing particles form a line of contact area as opposed to point contact areas. The wafer cleaning and polishing pad 10 can be any suitable shape or form and the shape of the wafer cleaning and polishing pad 10 shown in FIG. 1A is simply for illustrative purposes, and is therefore non-limiting.

FIG. 1B shows a side view of the wafer cleaning and polishing pad 10 shown in FIG. 1A. As shown in FIG. 1B, the wafer cleaning and polishing pad 10 includes the polishing surface 15 disposed on a middle layer 25 and the base 20. In some embodiments, the base 20 has a larger dimension than either or both of the polishing surface 15 or/and the middle layer 25, and thus surrounds circumferentially either or both the polishing surface 15 or/and the middle layer 25. The geometric arrangement shown in FIG. 1B is for illustrative purposes and thus is non-limiting, and any suitable geometric arrangement can be applied.

In some embodiments, the middle layer 25 includes a third material that has a lower hardness and higher static coefficient of friction compared to the first material of the polishing surface 15. In some embodiments, the third material includes a shock absorbing or buffer material. In some embodiments, the third material is configured to absorb pressure points and redistribute the pressure so as to form a more uniform pressure across surfaces of the middle layer 25 and/or the polishing surface 15. In some embodiments, the third material has a Shore D hardness ranging from about 10 to about 50. In some embodiments, the third material has a Shore D hardness below about 50, about 45, about 40, about 35, about 30, about 25, about 20, or about 15. In some embodiments, the third material has a Shore D hardness that varies from the center to the edge of the middle layer 25. In some embodiments, the varying Shore D hardness value of the middle layer 25 ranges from about 10 to about 50.

In some embodiments, the third material has a static coefficient of friction higher than about 0.4, about 0.6, about 0.8, about 1.0, about 1.2, about 1.4, or about 1.5. In some embodiments, the third material has a static coefficient of friction ranging from about 0.4 to about 1.5. In an embodiment, the third material includes a material made of a polyvinyl alcohol, a polyurethane, or any suitable material.

In some embodiments, the wafer cleaning and polishing pad 10 includes the polishing surface 15, the base 20, and the middle layer 25. In some embodiments, the wafer cleaning and polishing pad 10 includes the polishing surface 15, and the base 20, without the middle layer 25. When redistribution of the pressure is not an issue, the polishing surface 15 is disposed directly over the base 20 in some embodiments. In some embodiments, the wafer cleaning and polishing pad 10 includes the polishing surface 15, and the middle layer 25.

Figure 2:
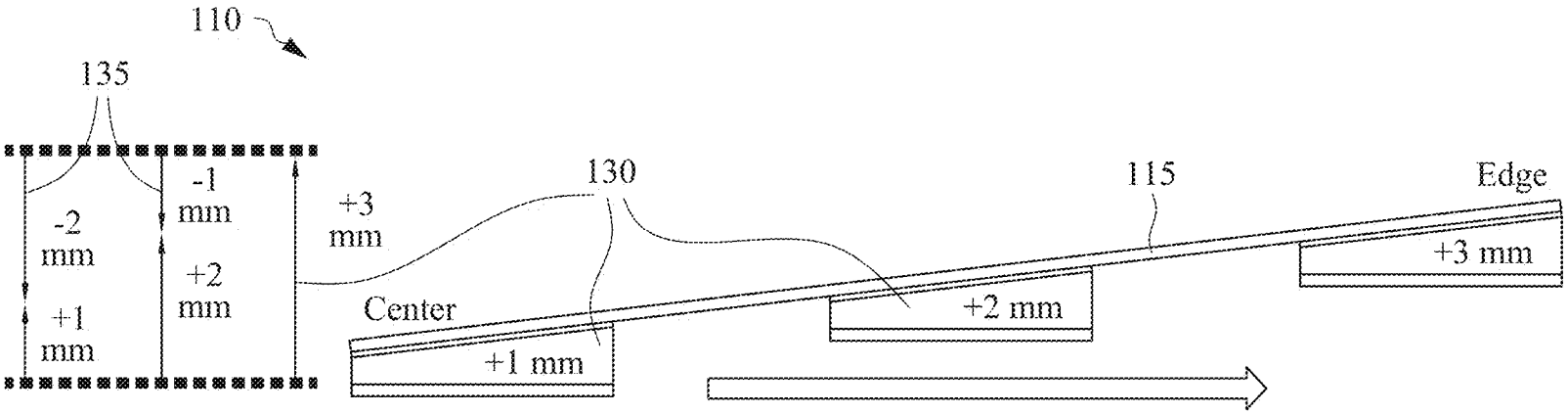
FIG. 2 shows a profile view of a wafer cleaning and polishing pad according to an embodiment of the disclosure.

FIG. 2 illustrates a profile view of a wafer cleaning and polishing pad 110 according to an embodiment of the disclosure. As illustrated in FIG. 2, the wafer cleaning and polishing pad 110 includes a polishing surface 115. The radius of the wafer cleaning and polishing pad 110 is shown in FIG. 2 from left to right, starting from the center of the wafer cleaning and polishing pad 110 on the left side to the edge of the wafer cleaning and polishing pad 110 on the right side of the figure. In some embodiments, the polishing surface is not planar relative to the horizontal plane. The polishing surface 115 is shown with a bend, and the distance 130 of the bend from the horizontal plane (in millimeters) increases from the center of the wafer cleaning and polishing pad 110 to an edge of the wafer cleaning and polishing pad 110. The bending distance 130 is configured to counter a bending 135 of the wafer or to apply pressure uniformly across a surface of the wafer while the wafer is being cleaned or polished, so that the bending of the wafer is cancelled to produce a flat, uniformly polished wafer. In some embodiments, the countering of the bending of the wafer occurs by increasing the pressure on the wafer by the wafer cleaning and polishing pad 110 while polishing. In some embodiments, the pressure exerted on the wafer varies from the center of the wafer to the edge of the wafer. As shown in FIG. 2, the bending of the polishing surface 115 ranges from about 1 mm at the center to about 3 mm at the edge so that the pressure exerted properly accommodates the bending to maintain the flatness of the wafer while polishing. As described herein, the pressure gradient (e.g., non-uniform pressure) can be exerted using a shock absorbing or buffer material, such as, for example, the third material of the middle layer 25, to ensure optimal contact between the wafer cleaning and polishing pad 110 and the backside of the wafer from the center to the edge. In some embodiments, the polishing surface 115 includes a varying thickness across the polishing surface 115 to counter bending of the wafer and/or the wafer cleaning and polishing pad 110 during a cleaning and polishing operation to improve the wafer backside flatness. In such instances, the shock absorbing or buffer material, such as the third material of the middle layer 25 is configured to ensure optimal contact between the wafer cleaning and polishing pad 110 and the backside of the wafer from the center to the edge.

In some embodiments, the wafer cleaning and polishing pad 110 shown in FIG. 2 is identical to the wafer cleaning and polishing pad 10 of FIG. 1A. Accordingly, the components of wafer cleaning and polishing pad 110 are identical to those of wafer cleaning and polishing pad 10.

In some embodiments, the wafer cleaning and polishing pad 110 shown in FIG. 2 is similar to the wafer cleaning and polishing pad 10 of FIG. 1A, but with a gradient in the thickness across the polishing surface. In some embodiments, the thickness of the polishing surface increases from the center to the edge of the wafer cleaning and polishing pad 110 by about 0.1 mm to about 4 mm, about 0.5 mm to about 3.5 mm, about 1 mm to about 3 mm, about 1.2 mm to about 2.8 mm, or about 1.5 mm to about 2.5 mm, inclusive of any range of values therebetween.

Figure 3:
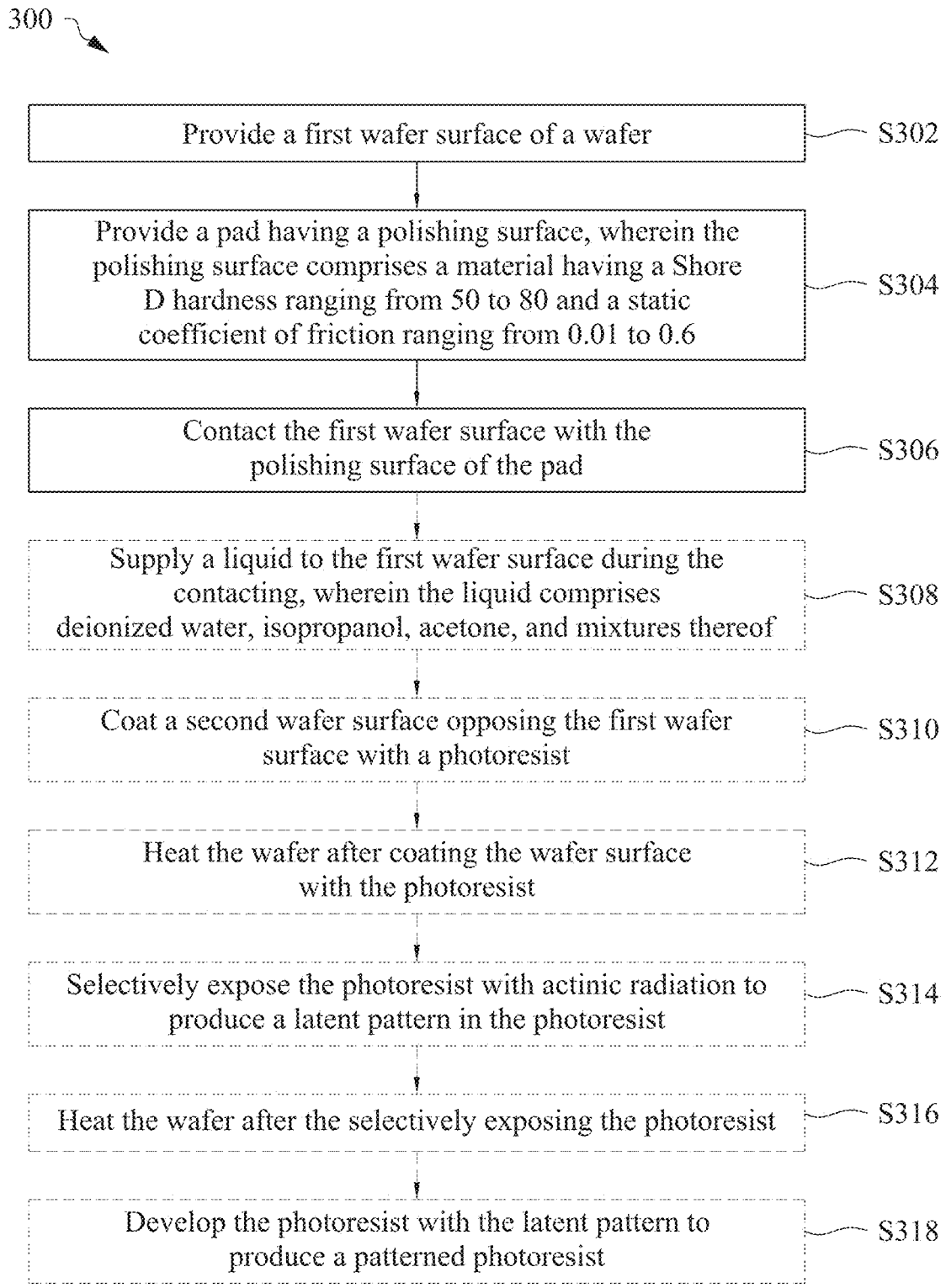
FIG. 3 shows a process flow for a method of cleaning and polishing a wafer according to an embodiment of the disclosure.

FIG. 3 shows a process flow for a method 300 of cleaning and polishing a wafer according to an embodiment of the disclosure. The method 300 includes providing a first wafer surface of the wafer, at operation S302.

In some embodiments of the disclosure, the wafer is a semiconductor wafer or a substrate. In some embodiments, the wafer includes a single crystalline semiconductor layer on at least its surface. In some embodiments, the wafer includes a single crystalline semiconductor material such as, but not limited to Si, Ge, SiGe, GaAs, InSb, GaP, GaSb, InAlAs, InGaAs, GaSbP, GaAsSb, and InP. In some embodiments, the wafer is made of Si. In some embodiments, the wafer is a silicon wafer. In some embodiments, the wafer is a semiconductor-on-insulator substrate fabricated using separation by implantation of oxygen (SIMOX), wafer bonding, and/or other suitable methods, such as a silicon-on-insulator (SOI) substrate, a silicon germanium-on-insulator (SGOI) substrate, or a germanium-on-insulator (GOI) substrate.

At operation S304, the method 300 includes providing a pad having a polishing surface, wherein the polishing surface includes a material having a Shore D hardness ranging from 50 to 80 and a static coefficient of friction ranging from 0.01 to 0.6. In some embodiments, the pad is the wafer cleaning and polishing pad 10 as shown and described with respect to FIG. 1A and/or the wafer cleaning and polishing pad 110 as shown and described with respect to FIG. 2. In some embodiments, the material is the first material as described with respect to FIG. 1A.

In some embodiments, the polishing surface used in the method 300 includes a fluoropolymer selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and a mixture thereof.

In some embodiments, the pad includes at least one of a middle layer or a base. In some embodiments, the pad includes the polishing surface and the middle layer. In some embodiments, the pad includes the polishing surface and the base. In some embodiments, the base includes the second material (as shown and described with respect to FIG. 1A). In some embodiments, the middle layer includes the third material (as shown and described with respect to FIG. 1B) having a lower surface hardness and a higher coefficient of friction than the first material. In some embodiments, the polishing surface includes a plurality of grooves with a varying groove depth from center of the pad to an edge of the pad.

At operation S306, the method 300 includes contacting the first wafer surface with the polishing surface of the pad. In some embodiments, contacting the first wafer surface includes either rotating the wafer or the pad with respect to each other so as to clean or polish the first wafer surface. In some embodiments, the first wafer surface is a backside surface of the wafer wherein a photoresist coating is formed on an opposite surface of the wafer.

At operation S308, the method 300 optionally includes supplying a liquid to the first wafer surface during the contacting, wherein the liquid comprises deionized water, isopropanol, acetone, and mixtures thereof.

At operation S310, the method 300 optionally includes coating a second wafer surface opposing the first wafer surface with a photoresist.

At operation S312, the method 300 optionally includes heating the wafer after coating the second wafer surface with the photoresist.

At operation S314, the method 300 optionally includes selectively exposing the photoresist with actinic radiation to produce a latent pattern in the photoresist.

At operation S316, the method 300 optionally includes heating the wafer after the selectively exposing the photoresist. In some embodiments, the wafer is heated at a temperature ranging from about 40° C. to about 200° C. for about 10 seconds to about 5 minutes.

At operation S318, the method 300 optionally includes developing the photoresist with the latent pattern to produce a patterned photoresist.

In some embodiments, the wafer is coated with a photoresist and then the coated wafer undergoes backside surface cleaning and polishing starting at operation S302. During the cleaning and polishing operation, particles are removed from the wafer by contacting the wafer backside with a pad. The cleaning and polishing operation according to the present disclosure provides a smooth and flat wafer backside without scratches and particle contamination. In some embodiments, the wafer or the pad is rotated during the cleaning and polishing operation. In some embodiments, a liquid is applied to the backside surface of the wafer during the cleaning and polishing operation. In some embodiments, the pressure of the pad contacting the wafer, the rotation speed of the wafer or pad, and the type of liquid is adjusted to optimize the cleaning and polishing operation.

Figure 4:
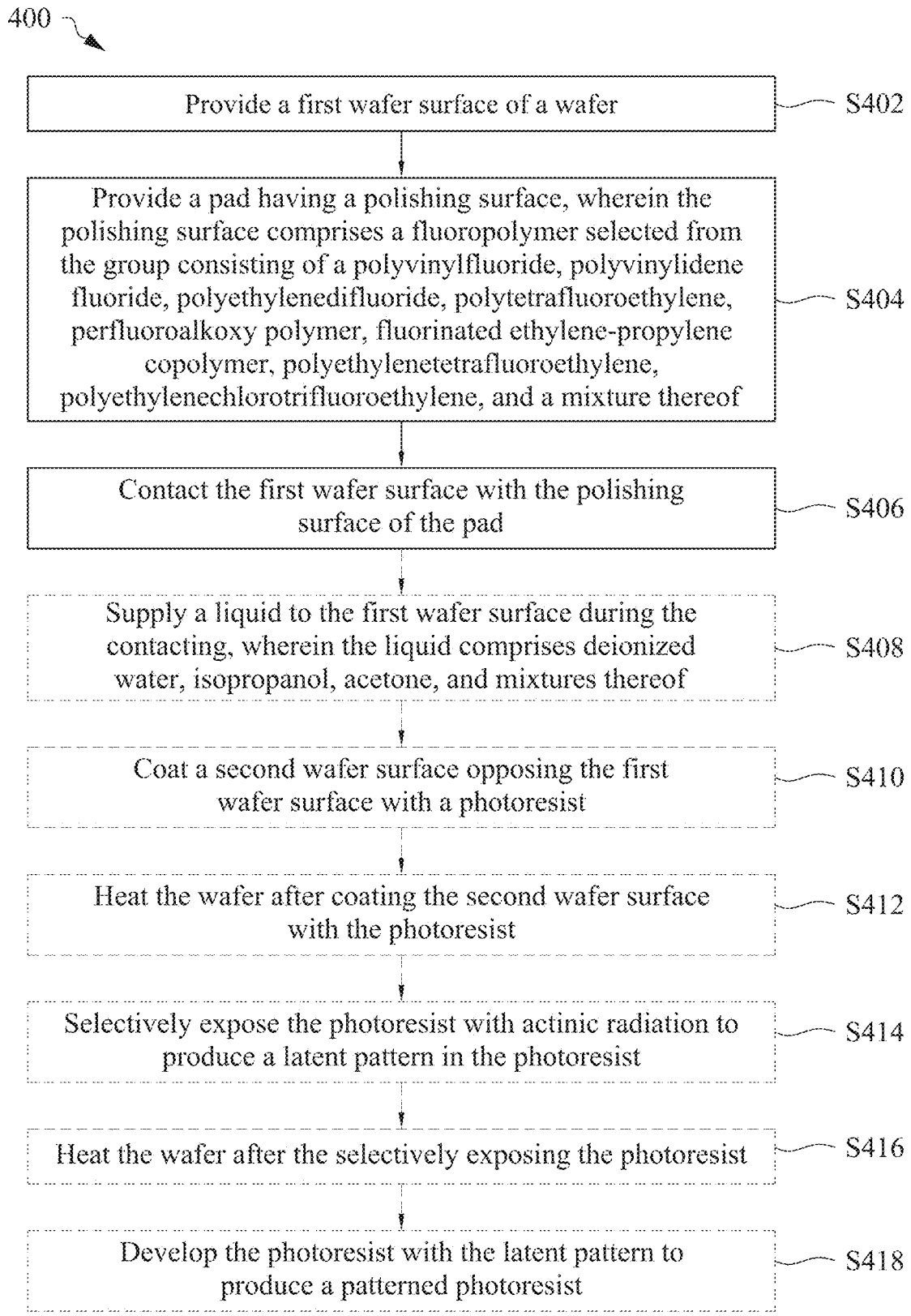
FIG. 4 shows another process flow for a method of cleaning and polishing a wafer according to an embodiment of the disclosure.

FIG. 4 shows another process flow for a method 400 of cleaning and polishing a wafer according to an embodiment of the disclosure. The method 400 begins with providing a first wafer surface of the wafer, at operation S402.

At operation S404, the method 400 includes providing a pad having a polishing surface, wherein the polishing surface includes a fluoropolymer selected from the group consisting of a polyvinylfluoride, polyvinylidene fluoride, polyethylenedifluoride, polytetrafluoroethylene, perfluoroalkoxy polymer, fluorinated ethylene-propylene copolymer, and polyethylenetetrafluoroethylene. In some embodiments, the wafer is the same as the wafer of the method 300, as described with respect to of FIG. 3. In some embodiments, the wafer is coated with a photoresist and then the coated wafer undergoes backside surface cleaning and polishing starting at operation S402.

In some embodiments, the pad is the same as the wafer cleaning and polishing pad 10 as shown and described with respect to FIG. 1A and/or the wafer cleaning and polishing pad 110 as shown and described with respect to FIG. 2.

In some embodiments, the polishing surface includes a material having a Shore D hardness ranging from 50 to 80 and a static coefficient of friction ranging from 0.01 to 0.6. In some embodiments, the material is the first material as described with respect to FIG. 1A.

In some embodiments, the pad includes at least one of a middle layer or a base. In some embodiments, the pad includes the polishing surface and the middle layer. In some embodiments, the pad includes the polishing surface and the base. In some embodiments, the base includes the second material (as shown and described with respect to FIG. 1A). In some embodiments, the middle layer includes the third material (as shown and described with respect to FIG. 1B) having a lower surface hardness and a higher coefficient of friction than the first material. In some embodiments, the polishing surface includes a plurality of grooves with varying groove depth from center of the pad to an edge of the pad.

At operation S406, the method 400 includes contacting the first wafer surface with the polishing surface of the pad. In some embodiments, contacting the first wafer surface includes either rotating the wafer or the pad with respect to each other so as to clean or polish the first wafer surface. In some embodiments, the first wafer surface is a backside surface of the wafer wherein a photoresist coating is formed on an opposite surface of the wafer.

At operation S408, the method 400 optionally includes supplying a liquid to the first wafer surface during the contacting, wherein the liquid comprises deionized water, isopropanol, acetone, and mixtures thereof.

At operation S410, the method 400 optionally includes coating a second wafer surface opposing the first wafer surface with a photoresist.

At operation S412, the method 400 optionally includes heating the wafer after coating the second wafer surface with the photoresist.

At operation S414, the method 400 optionally includes selectively exposing the photoresist with actinic radiation to produce a latent pattern in the photoresist.

At operation S416, the method 400 optionally includes heating the wafer after the selectively exposing the photoresist. In some embodiments, the wafer is heated at a temperature ranging from about 40° C. to about 200° C. for about 10 seconds to about 5 minutes.

At operation S418, the method 400 optionally includes developing the photoresist with the latent pattern to produce a patterned photoresist.

During the cleaning and polishing operation, particles are removed from the wafer by contacting the wafer backside with a pad. The cleaning and polishing operation according to the method 400 provides a smooth and flat wafer backside without scratches and particle contamination.

Figure 5:
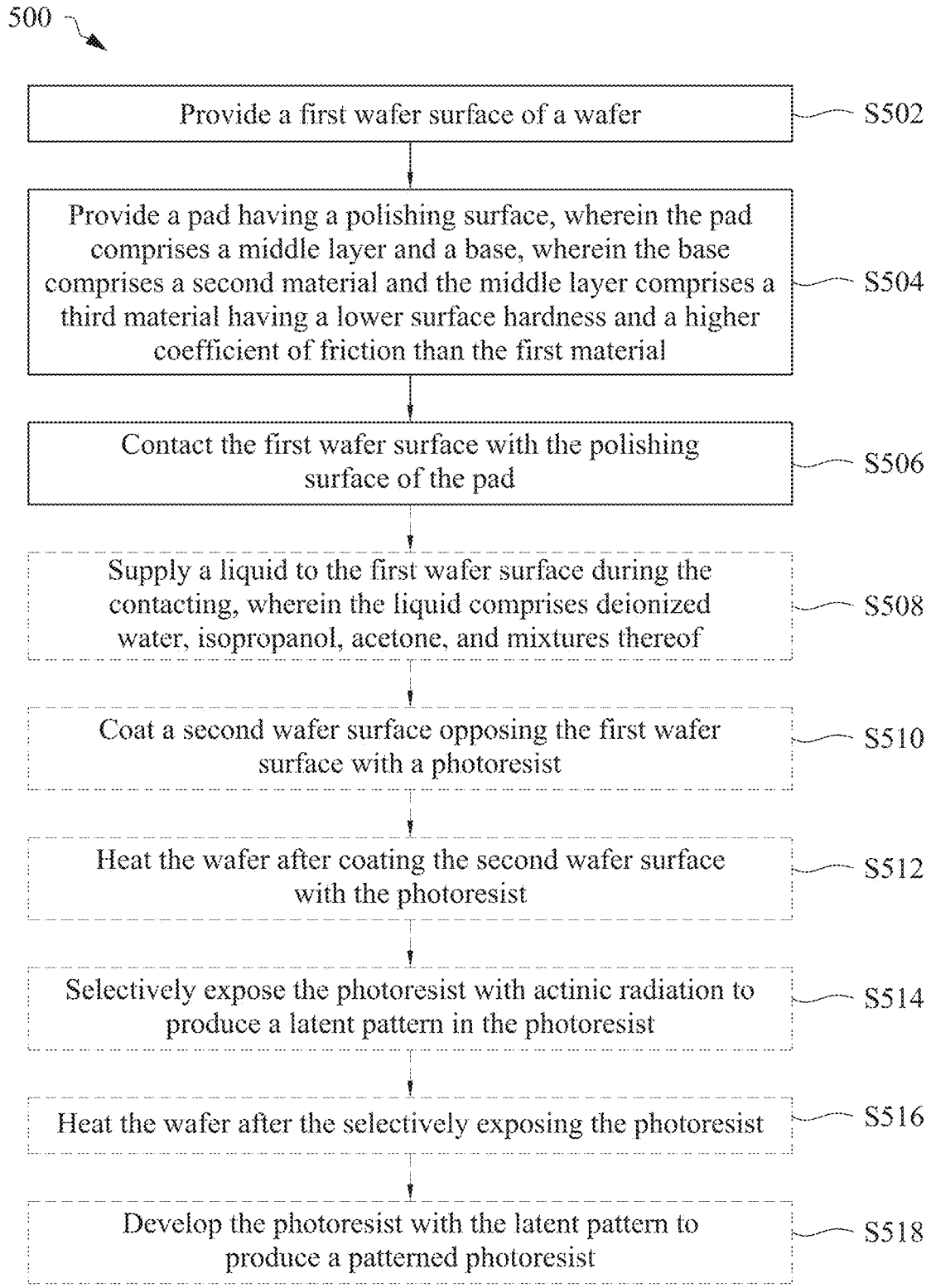
FIG. 5 shows another process flow for a method of cleaning and polishing a wafer according to an embodiment of the disclosure.

FIG. 5 shows another process flow for a method 500 of cleaning and polishing a wafer according to an embodiment of the disclosure. The method 500 includes providing a first wafer surface of the wafer, at operation S502.

In some embodiments, the wafer is the same as the wafer of the method 300, as described with respect to of FIG. 3. In some embodiments, the wafer is coated with a photoresist and then the coated wafer undergoes backside surface cleaning and polishing starting at operation S502.

In some embodiments, the pad is the same as the wafer cleaning and polishing pad 10 as shown and described with respect to FIG. 1A and/or the wafer cleaning and polishing pad 110 as shown and described with respect to FIG. 2. In some embodiments, the polishing surface includes a material having a Shore D hardness ranging from 50 to 80 and a static coefficient of friction ranging from 0.01 to 0.6. In some embodiments, the material is the first material as described with respect to FIG. 1A.

In some embodiments, the polishing surface includes a fluoropolymer selected from the group consisting of a polyvinylfluoride, polyvinylidene fluoride, polyethylenedifluoride, polytetrafluoroethylene, perfluoroalkoxy polymer, fluorinated ethylene-propylene copolymer, and polyethylenetetrafluoroethylene.

At operation S504, the method 500 includes providing a pad having a polishing surface, wherein the pad includes a middle layer and a base. In some embodiments, the base includes the second material (as shown and described with respect to FIG. 1A). In some embodiments, the base includes the third material (as shown and described with respect to FIG. 1B) having a lower surface hardness and a higher coefficient of friction than the first material. In some embodiments, the polishing surface includes a plurality of grooves with varying groove depth from center of the pad to an edge of the pad.

At operation S506, the method 500 includes contacting the first wafer surface with the polishing surface of the pad. In some embodiments, contacting the first wafer surface includes either rotating the wafer or the pad with respect to each other so as to clean or polish the first wafer surface. In some embodiments, the first wafer surface is a backside surface of the wafer wherein a photoresist coating is formed on an opposite surface of the wafer.

At operation S508, the method 500 optionally includes supplying a liquid to the first wafer surface during the contacting, wherein the liquid includes deionized water, isopropanol, acetone, and mixtures thereof.

At operation S510, the method 500 optionally includes coating a second wafer surface opposing the first wafer surface with a photoresist.

At operation S512, the method 500 optionally includes heating the wafer after coating the second wafer surface with the photoresist.

At operation S514, the method 500 optionally includes selectively exposing the photoresist with actinic radiation to produce a latent pattern in the photoresist.

At operation S516, the method 500 optionally includes heating the wafer after the selectively exposing the photoresist. In some embodiments, the wafer is heated at a temperature ranging from about 40° C. to about 200° C. for about 10 seconds to about 5 minutes.

At operation S518, the method 500 optionally includes developing the photoresist with the latent pattern to produce a patterned photoresist.

During the cleaning and polishing operation, particles are removed from the wafer by contacting the wafer backside with a pad. The cleaning and polishing operation according to the method 500 provides a smooth and flat wafer backside without scratches and particle contamination.

Figure 6A:
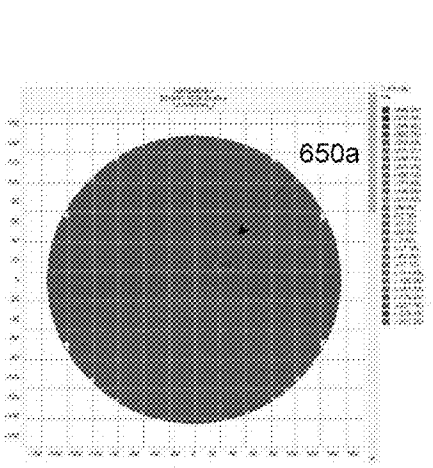
FIGS. 6A, 6B, 6C, and 6D illustrate the result of backside cleaning and polishing according to embodiments of the disclosure.
Figure 6B:
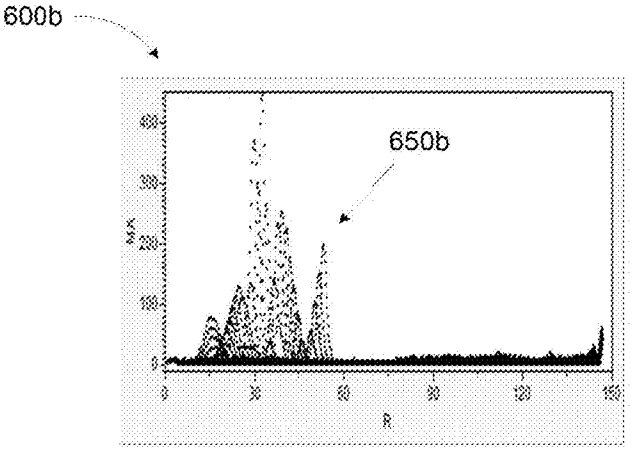

FIGS. 6A, 6B, 6C, and 6D illustrate the result of wafer cleaning and polishing according to embodiments of the disclosure. Diagram 600*a* in FIG. 6A illustrates a wafer having a plurality of particles or defects 650*a* disposed near the center of the wafer, e.g. the "dirty wafer". Diagram 600*b* in FIG. 6B shows a surface profile of the dirty wafer as a function of the radius R of the wafer shown in FIG. 6A. As illustrated in the surface profile, a plurality of peaks 650*b* can be identified between radius marks 15 and 60 in the surface profile of the wafer signifying the presence of plurality of particles or defects 650*a*.

Figure 6C:
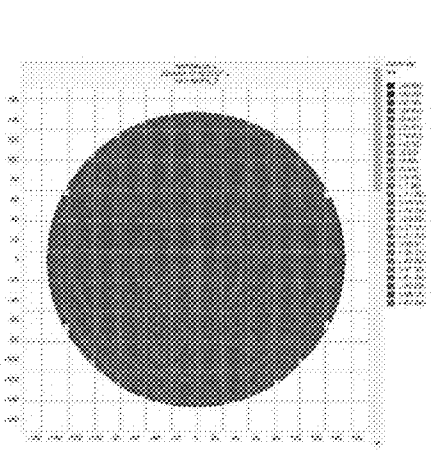
Figure 6D:
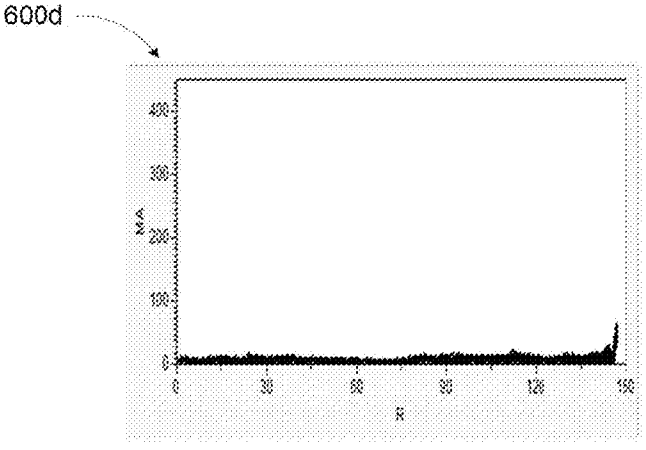

Diagram 600*c* in FIG. 6C illustrates the wafer as shown in FIG. 6A that has undergone the wafer cleaning and polishing process as disclosed herein using the cleaning and polishing apparatus as disclosed herein. Diagram 600*d* in FIG. 6D shows a surface profile of the wafer that has been cleaned, e.g. the "clean wafer". As illustrated in FIG. 6D, the surface profile of the clean wafer no longer shows the plurality of peaks 650*b* that were present in FIG. 6B. After the cleaning and polishing operation, the plurality of particles or defects 650*a* are removed from the wafer the cleaning and polishing operation according to the methods disclosed herein, which results in a smooth and flat wafer backside without scratches and particle contamination. In particular, the wafer cleaning and polishing method and cleaning and polishing devices of the present disclosure provide an improvement in backside particle removal and flatness over 90% compared to conventional wafer cleaning and polishing. By comparing the surface profile of the dirty wafer of FIG. 6B and that of the cleaned wafer in FIG. 6D, the difference in the surface roughness exhibits an unexpected improvement of over 90% in terms of surface profile measurements. For example, the peak height of the wafer due to the plurality of particles or defects 650*a* decreases from 445 nm to 26 nm at the radius R value 33.

Figure 7B:
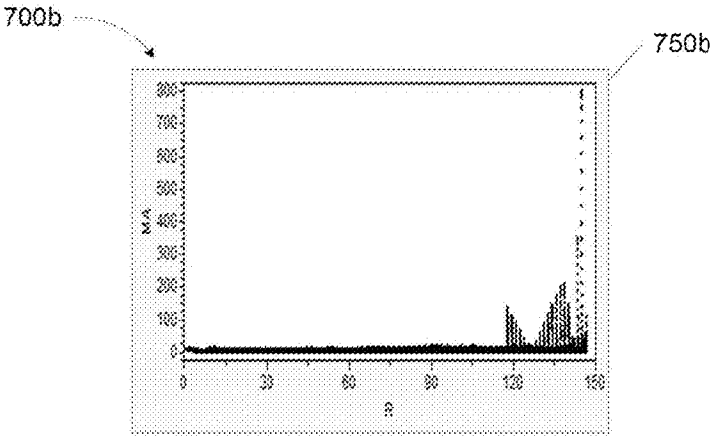
FIGS. 7A, 7B, 7C, and 7D illustrate the result of backside cleaning and polishing according to embodiments of the disclosure.
Figure 7D:
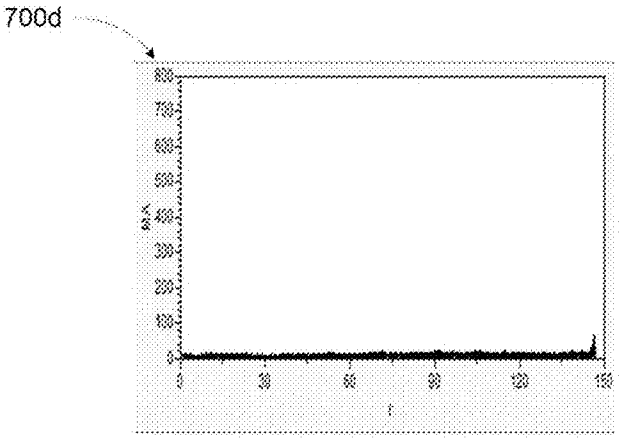
Figure 7A:
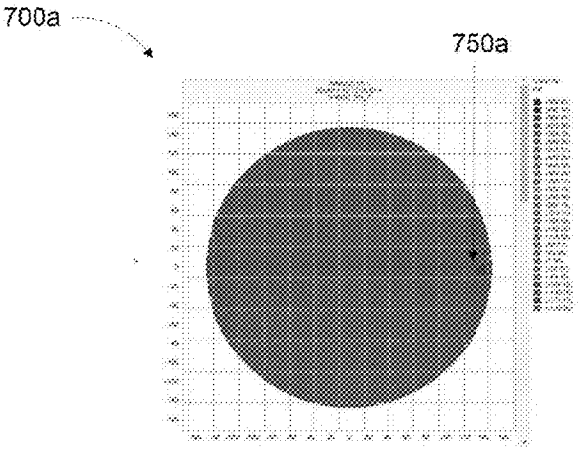

FIGS. 7A, 7B, 7C, and 7D illustrate the result of wafer cleaning and polishing according to embodiments of the disclosure. Diagram 700*a* in FIG. 7A illustrates a wafer having a plurality of particles or defects 750*a* disposed near the center of the wafer, e.g. the "dirty wafer". Diagram 700*b* in FIG. 7B shows a surface profile of the dirty wafer as a function of the radius R of the wafer shown in FIG. 7A. As illustrated in the surface profile, a plurality of peaks 750*b* can be identified between radius values 110 and 150 in the surface profile of the wafer signifying the presence of plurality of particles or defects 750*a*.

Figure 7C:
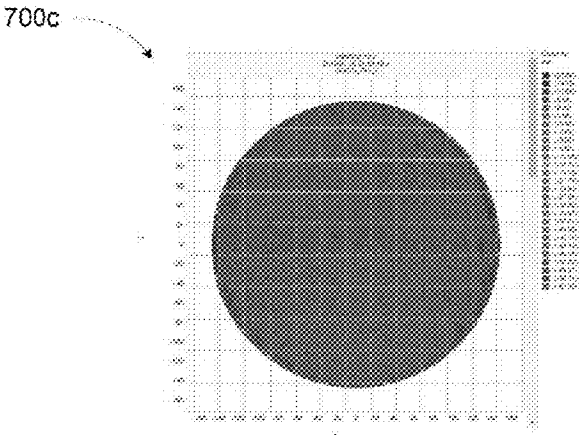

Diagram 700*c* in FIG. 7C illustrates the wafer as shown in FIG. 7A that has undergone the wafer cleaning and polishing process as disclosed herein using the cleaning and polishing apparatus as disclosed herein. Diagram 700*d* in FIG. 7D shows a surface profile of the wafer that has been cleaned, e.g. the "clean wafer". As illustrated in FIG. 7D, the surface profile of the clean wafer no longer shows the plurality of peaks 750*b* that were present in FIG. 7B. After the cleaning and polishing operation according to embodiments of the disclosure, the plurality of particles or defects 750*a* are removed from the wafer, which results in a smooth and flat wafer backside without scratches and particle contamination. In particular, the wafer cleaning and polishing method and cleaning and polishing devices of the present disclosure provide an improvement in backside particle removal and flatness over 90% compared to conventional wafer cleaning and polishing. By comparing the surface profile of the dirty wafer of FIG. 7B and that of the cleaned wafer in FIG. 7D, the difference in the surface roughness exhibits an unexpected improvement of over 90% in the surface profile measurements. For example, the peak height of the wafer due to the plurality of particles or defects 750*a* decreases from 800 nm to 61 nm at the radius R value 145.

It is understood that the semiconductor devices formed according to the disclosed methods undergo further processes, including material deposition, implantation, or etching operations, to form various features such as field effect transistors, cap insulating layers, contacts/vias, silicide layers, interconnect metal layers, dielectric layers, passivation layers, metallization layers with signal lines, etc. In some embodiments, one or more layers of conductive, semiconductive, and insulating materials are formed over the substrate, and a pattern is formed in one or more of the layers.

A wafer backside cleaning and polishing apparatus and the methods of operating the apparatus as described herein allow for reduction or elimination of wafer backside scratching. According to various embodiments of the disclosure, the disclosed apparatus and methods provide an expected improvement in the reduction of photolithographic exposure focus and overlay errors, and provide an unexpected improvement in the yield in the production of high quality devices.

An embodiment of the disclosure is a wafer cleaning and polishing pad. The wafer cleaning and polishing pad includes a pad having a polishing surface, wherein the polishing surface includes a first material having a Shore D hardness ranging from 50 to 80 and a static coefficient of friction ranging from 0.01 to 0.6. In an embodiment, the first material is a fluoropolymer. In an embodiment, the fluoropolymer is selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and a mixture thereof. In an embodiment, the wafer cleaning and polishing pad includes at least one of a middle layer or a base. In an embodiment, the base includes a second material. In an embodiment, the middle layer includes a third material having a lower surface hardness and a higher coefficient of friction than the first material. In an embodiment, the second material or the third material has a static coefficient of friction ranging from 0.4 to 1.5. In an embodiment, the second material is a polyvinyl chloride and the third material is a polyvinyl alcohol or a polyurethane. In an embodiment, a bending of the polishing surface increases from center of the pad to an edge of the pad or the pad is configured to uniformly apply pressure across a surface of a wafer during cleaning and polishing. In an embodiment, the bending of the polishing surface increases from 1 mm to 3 mm from the center of the pad to the edge of the pad to accommodate the applied pressure.

Another embodiment of the disclosure is a wafer cleaning and polishing chamber. The chamber includes a cleaning and polishing solution supply, a wafer support, a motor configured to spin the wafer support, a polishing arm, and a wafer cleaning and polishing pad fixed to the polishing arm. The wafer cleaning and polishing pad includes a pad having a polishing surface, and wherein the polishing surface includes a first material having a Shore D hardness ranging from 50 to 80 and a static coefficient of friction ranging from 0.01 to 0.6. In an embodiment, the polishing surface comprises a fluoropolymer selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and a mixture thereof. In an embodiment, the pad further includes at least one of a middle layer or a base. In an embodiment, the base includes a second material. In an embodiment, the middle layer includes a third material having a lower surface hardness and a higher coefficient of friction than the first material. The second material is a polyvinyl chloride or the third material is a polyvinyl alcohol or a polyurethane. In an embodiment, the second material or the third material has a static coefficient of friction ranging from 0.4 to 1.5. In an embodiment, a bending of the polishing surface increases from 1 mm to 3 mm from center of the pad to an edge of the pad or the pad is configured to uniformly apply pressure across a surface of a wafer during cleaning and polishing.

Another embodiment of the disclosure is a method of cleaning and polishing a wafer. The method includes providing a first wafer surface, providing a pad having a polishing surface, wherein the polishing surface includes a material having a Shore D hardness ranging from 50 to 80 and a static coefficient of friction ranging from 0.01 to 0.6, and contacting the first wafer surface with the polishing surface of the pad. In an embodiment of the method, contacting the first wafer surface includes either rotating the wafer or the pad with respect to each other so as to clean or polish the first wafer surface. In an embodiment, the first wafer surface is a backside surface of the wafer having a photoresist coating on an opposite surface of the wafer. In an embodiment, the method includes supplying a liquid to the first wafer surface during the contacting, wherein the liquid comprises deionized water, isopropanol, acetone, and mixtures thereof. In an embodiment, the method also includes coating a second wafer surface opposing the first wafer surface with a photoresist. In an embodiment, the method includes heating the wafer after coating the second wafer surface with the photoresist. In an embodiment, the method includes selectively exposing the photoresist with actinic radiation to produce a latent pattern in the photoresist. In an embodiment, the method includes heating the wafer after the selectively exposing the photoresist. In an embodiment, the method further includes developing the photoresist with the latent pattern to produce a patterned photoresist. In an embodiment of the method, the polishing surface includes a fluoropolymer selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and a mixture thereof. In an embodiment, the pad includes at least one of a middle layer or a base. The base includes a second material. The middle layer includes a third material having a lower surface hardness and a higher coefficient of friction than the first material. In an embodiment, wherein the second material is a polyvinyl chloride and the third material is a polyvinyl alcohol or a polyurethane.

Another embodiment of the disclosure is a semiconductor device processing apparatus. The apparatus includes a cleaning and polishing chamber and a processing chamber downstream from the cleaning and polishing chamber. The cleaning and processing chamber includes a cleaning and polishing solution supply, a wafer support, a motor configured to spin the wafer support, a polishing arm, and a wafer cleaning and polishing pad fixed to the polishing arm. The wafer cleaning and polishing pad includes a pad having a polishing surface, and wherein the polishing surface includes a material having a Shore D hardness ranging from 50 to 80, and a coefficient of static friction ranging from 0.01 to 0.6. In an embodiment, the processing chamber includes a wafer stepper or a wafer scanner. In an embodiment, the apparatus further includes a photoresist coating chamber upstream from the cleaning and polishing chamber. In an embodiment, the polishing surface has a static coefficient of friction ranging from 0.05 to 0.4. In an embodiment, the polishing surface has a static coefficient of friction less than or equal to 0.1. In an embodiment, the polishing surface is made of a fluoropolymer. In an embodiment, the fluoropolymer is selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and a mixture thereof. In an embodiment, the pad includes a base. In an embodiment, the base includes a material having a Shore D hardness ranging from 50 to 80 and a static coefficient of friction ranging from 0.4 to 1.5. In an embodiment, the base comprises a polyvinyl chloride. In an embodiment, the pad includes a middle layer, wherein the middle layer is formed of a material having a lower surface hardness and a higher coefficient of friction than the polishing surface. In an embodiment, the middle layer includes a material having a Shore D hardness ranging from 15 to 50 and a static coefficient of friction ranging from 0.4 to 1.5. In an embodiment, the middle layer includes a polyvinyl alcohol or a polyurethane. In an embodiment, a bending of the polishing surface increases from center of the pad to an edge of the pad. In an embodiment, the pad is configured to uniformly apply pressure across a surface of a wafer during cleaning and polishing. In an embodiment, the bending of the polishing surface increases from 1 mm to 3 mm from the center of the pad to the edge of the pad to accommodate the applied pressure. In an embodiment, the third material of the middle layer reduces in thickness to accommodate the bending of the polishing surface.

Another embodiment of the disclosure is a method of cleaning and polishing a wafer. The method includes providing a first wafer surface, providing a pad having a polishing surface, wherein the polishing surface includes a fluoropolymer selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and a mixture thereof. In an embodiment, the pad includes at least one of a middle layer or a base. The base includes a second material that is different from the first material. The middle layer includes a third material having a lower surface hardness and a higher coefficient of friction than the first material. The method also includes contacting the first wafer surface with the polishing surface of the pad. In an embodiment of the method, contacting the first wafer surface includes rotating the wafer or the pad with respect to each other so as to clean or polish the first wafer surface. In an embodiment, the first wafer surface is a backside surface of the wafer having a photoresist coating on an opposite surface of the wafer. In an embodiment, the method includes supplying a liquid to the first wafer surface during the contacting, wherein the liquid comprises deionized water, isopropanol, acetone, and mixtures thereof. In an embodiment, the method also includes coating a second wafer surface opposing the first wafer surface with a photoresist. In an embodiment, the method includes heating the wafer after coating the second wafer surface with the photoresist. In an embodiment, the method includes selectively exposing the photoresist with actinic radiation to produce a latent pattern in the photoresist. In an embodiment, the method includes heating the wafer after the selectively exposing the photoresist. In an embodiment, the method further includes developing the photoresist with the latent pattern to produce a patterned photoresist. In an embodiment of the method, the polishing surface includes a material having a Shore D hardness ranging from 50 to 80 and a static coefficient of friction ranging from 0.01 to 0.6. In an embodiment, a thickness of the polishing surface increases from center of the pad to an edge of the pad.

Another embodiment of the disclosure is a method of cleaning and polishing a wafer. The method includes providing a first wafer surface, providing a pad having a polishing surface, wherein the pad includes at least one of a middle layer or a base, wherein the base includes a second material that is different from the first material, and the middle layer includes a third material having a lower surface hardness and a higher coefficient of friction than the first material, and contacting the first wafer surface with the polishing surface of the pad. In an embodiment of the method, contacting the first wafer surface includes either rotating the wafer or the pad with respect to each other so as to clean or polish the first wafer surface. In an embodiment, the first wafer surface is a backside surface of the wafer having a photoresist coating on an opposite surface of the wafer. In an embodiment, the method includes supplying a liquid to the first wafer surface during the contacting, wherein the liquid comprises deionized water, isopropanol, acetone, and mixtures thereof. In an embodiment, the method also includes coating a second wafer surface opposing the first wafer surface with a photoresist. In an embodiment, the method includes heating the wafer after coating the second wafer surface with the photoresist. In an embodiment, the method includes selectively exposing the photoresist with actinic radiation to produce a latent pattern in the photoresist. In an embodiment, the method includes heating the wafer after the selectively exposing the photoresist. In an embodiment, the method further includes developing the photoresist with the latent pattern to produce a patterned photoresist. In an embodiment, the polishing surface includes a material having a Shore D hardness ranging from 50 to 80 and a static coefficient of friction ranging from 0.01 to 0.6. In an embodiment of the method, the polishing surface includes a fluoropolymer selected from the group consisting of a polyvinylfluoride, polyvinylidene fluoride, polyethylenedifluoride, polytetrafluoroethylene, perfluoroalkoxy polymer, fluorinated ethylene-propylene copolymer, polyethylenetetrafluoroethylene, polyethylenechlorotrifluoroethylene, and a mixture thereof. In an embodiment, a thickness of the polishing surface increases from center of the pad to an edge of the pad.

The foregoing outlines features of several embodiments or examples so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments or examples introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A wafer cleaning and polishing pad, comprising:

a pad layer having a polishing surface and a back surface;

a middle layer disposed on the back surface of the pad layer; and a base layer disposed over the middle layer, wherein:

the polishing surface comprises a first material having a Shore D hardness ranging from 50 to 80, the wafer cleaning and polishing pad includes a radius beginning at a center of the wafer cleaning and polishing pad and extending to an edge of the wafer cleaning and polishing pad, the polishing surface is continuous from the center of the wafer cleaning and polishing pad to the edge of the wafer cleaning and polishing pad, the wafer cleaning and polishing pad has a gradient of increasing thickness beginning at the center of the wafer cleaning and polishing pad and continuing across the polishing surface to the edge of the wafer cleaning and polishing pad, wherein an increase of the thickness of the wafer cleaning and polishing pad from the center to the edge of the wafer cleaning and polishing pad is in a range from 0.1 mm to 4.0 mm, the polishing surface includes a plurality of grooves having groove depths that decrease from the center of the wafer cleaning and polishing pad to the edge of the wafer cleaning and polishing pad, the first material is a fluoropolymer selected from the group consisting of polyethylenedifluoride, perfluoroalkoxy polymer, fluorinated ethylene-propylene copolymer, polyethylenetetrafluoroethylene, polyethylenechlorotrifluoroethylene, and a mixture thereof, the base layer comprises a second material, and the middle layer comprises a third material different from the first material and having a lower surface hardness.

2. The wafer cleaning and polishing pad of claim 1, wherein the third material is a polyvinyl alcohol or a polyurethane.

3. The wafer cleaning and polishing pad of claim 2, wherein the second material is a polyvinyl chloride.

4. The wafer cleaning and polishing pad of claim 1, wherein third material is a polyvinyl alcohol.

5. The wafer cleaning and polishing pad of claim 1, wherein the third material has a Shore D hardness ranging from 10 to 50.

6. The wafer cleaning and polishing pad of claim 1, wherein the second material has a Shore D hardness ranging from 50 to 80.

7. The wafer cleaning and polishing pad of claim 1, wherein the base layer has a larger diameter than the pad layer.

8. The wafer cleaning and polishing pad of claim 1, wherein the second material is a polyvinyl chloride.

9. A method of cleaning and polishing a wafer, comprising:

providing a first wafer surface;

providing a pad including a pad layer having a polishing surface and a back surface, wherein:

the pad includes a radius beginning at a center of the pad and extending to an edge of the pad, the polishing surface is continuous from the center of the pad to the edge of the pad, the pad has a gradient of increasing thickness beginning at the center of the pad and continuing across the polishing surface to the edge of the pad, wherein an increase of the thickness of the pad from the center to the edge of the pad is in a range from 0.5 mm to 3.5 mm, the polishing surface includes a plurality of grooves having groove depths that decrease from the center of the pad to the edge of the pad, the pad includes a middle layer disposed on the back surface of the pad layer and a base layer disposed over the middle layer, the base layer comprises a second material, the polishing surface comprises a first material having a Shore D hardness ranging from 50 to 80 selected from the group consisting of polyethylenedifluoride, perfluoroalkoxy polymer, fluorinated ethylene-propylene copolymer, polyethylenetetrafluoroethylene, polyethylenechlorotrifluoroethylene, and a mixture thereof, and the middle layer comprises a third material different from the first material and having a lower surface hardness; and contacting the first wafer surface with the polishing surface of the pad.

10. The method according to claim 9, wherein the second material is a polyvinyl chloride and the third material is a polyvinyl alcohol or a polyurethane.

11. The method of cleaning and polishing a wafer of claim 9, wherein the base layer has a larger diameter than the pad layer.

12. The method of cleaning and polishing a wafer of claim 9, wherein the second material has a Shore D hardness ranging from 50 to 80.

13. The method of cleaning and polishing a wafer of claim 9, wherein the third material has a Shore D hardness ranging from 10 to 50.

14. A wafer cleaning and polishing pad, comprising:

a pad layer having a polishing surface and a back surface;

a middle layer disposed on the back surface of the pad layer; and a base layer disposed over the middle layer, wherein:

the polishing surface comprises a first material selected from the group consisting of polyethylenedifluoride, perfluoroalkoxy polymer, fluorinated ethylene-propylene copolymer, polyethylenetetrafluoroethylene, polyethylenechlorotrifluoroethylene, and a mixture thereof, the wafer cleaning and polishing pad includes a radius beginning at a center of the wafer cleaning and polishing pad and extending to an edge of the wafer cleaning and polishing pad, the polishing surface is continuous from the center of the wafer cleaning and polishing pad to the edge of the wafer cleaning and polishing pad, the wafer cleaning and polishing pad has a gradient of increasing thickness beginning at the center of the wafer cleaning and polishing pad and continuing across the polishing surface to the edge of the wafer cleaning and polishing pad, the polishing surface includes a plurality of grooves having groove depths that decrease from the center of the wafer cleaning and polishing pad to the edge of the wafer cleaning and polishing pad, the base layer comprises a second material, and the middle layer comprises a third material different from the first material and having a lower surface hardness.

15. The wafer cleaning and polishing pad of claim 14, wherein the third material is a polyvinyl alcohol.

16. The wafer cleaning and polishing pad of claim 15, wherein the second material is a polyvinyl chloride.

17. The wafer cleaning and polishing pad of claim 14, wherein the base layer has a larger diameter than the pad layer.

18. The wafer cleaning and polishing pad of claim 14, wherein the first material has a Shore D hardness ranging from 50 to 80.

19. The wafer cleaning and polishing pad of claim 14, wherein the second material has a Shore D hardness ranging from 50 to 80.

20. The wafer cleaning and polishing pad of claim 14, wherein the third material has a Shore D hardness ranging from 10 to 50.

* * * * *